US006901824B1

(12) United States Patent
Chen

(10) Patent No.: US 6,901,824 B1
(45) Date of Patent: Jun. 7, 2005

(54) RATCHET WRENCH STRUCTURE

(76) Inventor: Yu Tang Chen, No.1, Alley 16, Lane 40, Jinn Te Rd., Taichung (TW)

( * ) Notice: Subject to any disclaimer, the term of this patent is extended or adjusted under 35 U.S.C. 154(b) by 43 days.

(21) Appl. No.: 10/444,781

(22) Filed: May 22, 2003

(51) Int. Cl.[7] ..... B25B 13/46
(52) U.S. Cl. ..... 81/63.2; 81/60; 81/186; 81/185; 81/121.1
(58) Field of Search ..... 81/63.2, 60, 121.1, 81/185, 124.4, 124.5, 438, 186

(56) References Cited

U.S. PATENT DOCUMENTS 5,295,422 A * 3/1994 Chow ..... 81/124.3
2003/0221522 A1 * 12/2003 Wu ..... 81/63.2
2004/0035257 A1 * 2/2004 Tuan-Mu ..... 81/63.2
2004/0099098 A1 * 5/2004 Chen ..... 81/60
2004/0134313 A1 * 7/2004 Liu ..... 81/63.2
2004/0149088 A1 * 8/2004 Yamamoto ..... 81/121.1

* cited by examiner

*Primary Examiner*—Derris H. Banks
*Assistant Examiner*—Ali Abdelwahed

(57) ABSTRACT

A ratchet wrench structure includes a wrench body, a ratchet wheel, and a socket. The ratchet wheel has a center formed with a combination hole which has an inner periphery formed with a plurality of insertion ribs. Each of the insertion ribs of the ratchet wheel includes two first insertion faces located on the two opposite sides thereof, and a second insertion face located between the two first insertion faces. Thus, the ratchet wrench structure is available for sockets with sector-shaped and arcuate-shaped insertion recesses.

6 Claims, 16 Drawing Sheets

RATCHET WRENCH STRUCTURE

BACKGROUND OF THE INVENTION

1. Field of the Invention

The present invention relates to a ratchet wrench structure, and more particularly to a ratchet wrench structure that is both available for sockets with sector-shaped and arcuate-shaped insertion recesses.

2. Description of the Related Art

A first conventional ratchet wrench structure in accordance with the prior art shown in FIG. 8 comprises a wrench body 10A, a ratchet wheel 12A rotatably mounted in the wrench body 10A and having an inner wall formed with a plurality of arcuate insertion ribs 120A, and a socket 61A mounted in the ratchet wheel 12A and having an outer periphery formed with a plurality of arcuate insertion recesses 610A for insertion of the insertion ribs 120A of the ratchet wheel 12A. Thus, the socket 61A is combined with the ratchet wheel 12A, so that the socket 61A can co-operate with the ratchet wheel 12A to rotate a screw member (not shown) by rotation of the wrench body 10A. However, the conventional ratchet wrench structure is only available for the socket 61A with arcuate insertion recesses 610A shown in FIG. 8, and is not available for the socket 60A with sector-shaped insertion recesses 600A shown in FIG. 8A, thereby limiting the versatility of the conventional ratchet wrench structure.

As shown in FIG. 9, a screw member 62A is mounted in the ratchet wheel 12A, and each side of the screw member 62A is rested on a respective insertion rib 120A of the ratchet wheel 12A. However, each side of the screw member 62A only contacts one insertion rib 120A of the ratchet wheel 12A, thereby easily producing a slip movement between the screw member 62A and the ratchet wheel 12A during rotation of the wrench body 10A. In addition, each of the insertion ribs 120A of the ratchet wheel 12A is easily worn out during a long-term utilization.

A second conventional ratchet wrench structure shown in FIG. 10 comprises a wrench body 10B, a ratchet wheel 12B rotatably mounted in the wrench body 10B and having an inner wall formed with a plurality of sector-shaped insertion ribs 120B. As shown in FIG. 10, the screw member 62A is mounted in the ratchet wheel 12B, and each side of the screw member 62A is rested on a respective insertion rib 120B of the ratchet wheel 12B. However, the corner of each of the sector-shaped insertion ribs 120B is easily worn out due to rubbing during a long-term utilization.

SUMMARY OF THE INVENTION

The present invention is to mitigate and/or obviate the disadvantage of the conventional ratchet wrench structure.

The primary objective of the present invention is to provide a ratchet wrench structure that is available for the socket with the sector-shaped and arcuate-shaped insertion recesses.

Another objective of the present invention is to provide a ratchet wrench structure, wherein the two connections located between the second insertion face and each of the two first insertion faces of each of the insertion ribs are rested on each side of the screw member, so that the screw member s combined with the ratchet wheel rigidly and stably without incurring a slip movement.

A further objective of the present invention is to provide a ratchet wrench structure, wherein each of the insertion ribs and the screw member have a larger contact area, thereby preventing the insertion ribs from being worn out due to rubbing.

In accordance with the present invention, there is provided a ratchet wrench structure, comprising a wrench body, a ratchet wheel, and a socket, wherein:

the wrench body has a head formed with a receiving hole;

the ratchet wheel is rotatably mounted in the receiving hole of the wrench body and has a center formed with a combination hole, the combination hole of the ratchet wheel has an inner periphery formed with a plurality of insertion ribs, each of the insertion ribs of the ratchet wheel includes two first insertion faces located on the two opposite sides thereof, and a second insertion face located between the two first insertion faces; and the socket has one end having an outer periphery formed with a plurality of insertion recesses for insertion of the insertion ribs of the ratchet wheel.

Further benefits and advantages of the present invention will become apparent after a careful reading of the detailed description with appropriate reference to the accompanying drawings.

DETAILED DESCRIPTION OF THE INVENTION

Figure 1:
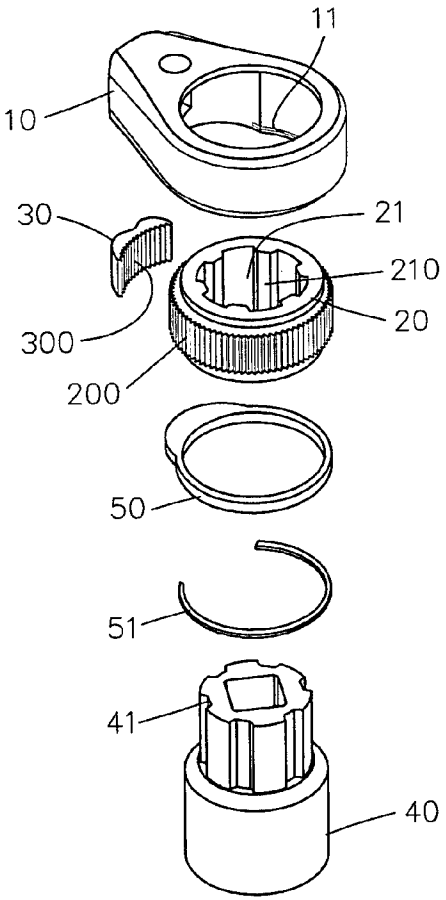
FIG. 1 is an exploded perspective view of a ratchet wrench structure in accordance with the preferred embodiment of the present invention.
Figure 2:
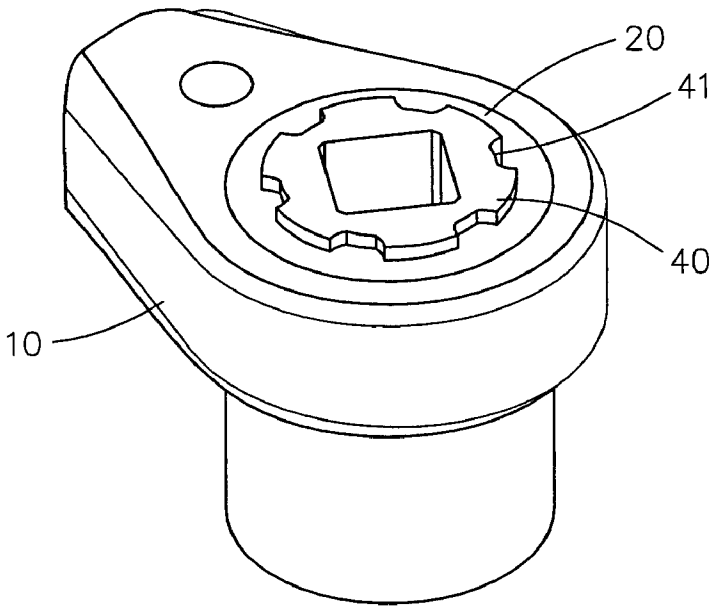
FIG. 2 is a perspective assembly view of the ratchet wrench structure in accordance with the preferred embodiment of the present invention.
Figure 3:
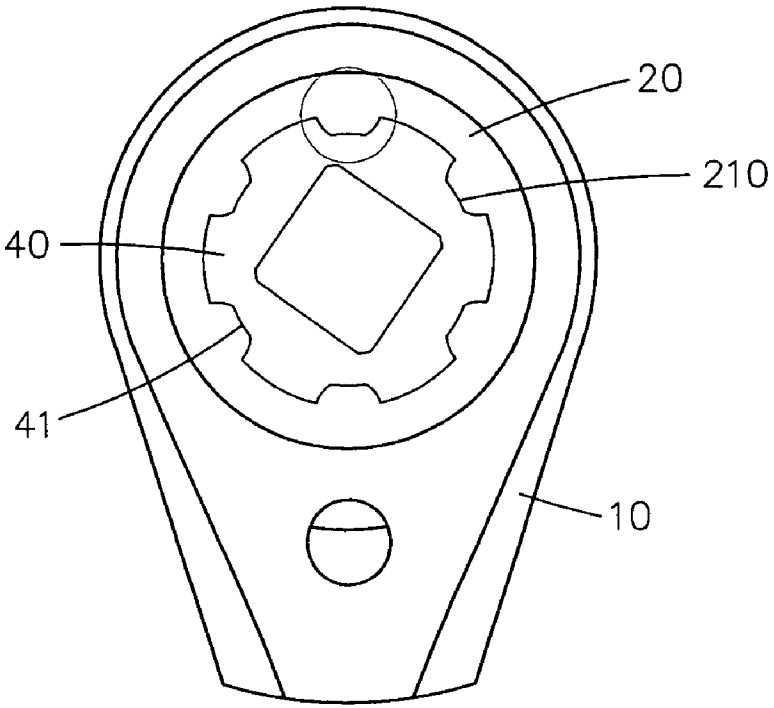
FIG. 3 is a top plan view of the ratchet wrench structure as shown in FIG. 2.

Referring to the drawings and initially to FIGS. 1–3, a ratchet wrench structure in accordance with the preferred embodiment of the present invention comprises a wrench body 10, a ratchet wheel 20, and a socket 40.

The wrench body 10 has a head formed with a receiving hole 11.

The ratchet wheel 20 is rotatably mounted in the receiving hole 11 of the wrench body 10. The ratchet wheel 20 has an outer wall formed with a plurality of ratchet teeth 200. The ratchet wheel 20 has a center formed with a combination hole 21. The combination hole 21 of the ratchet wheel 20 has an inner periphery formed with a plurality of insertion ribs 210.

Figure 3A:
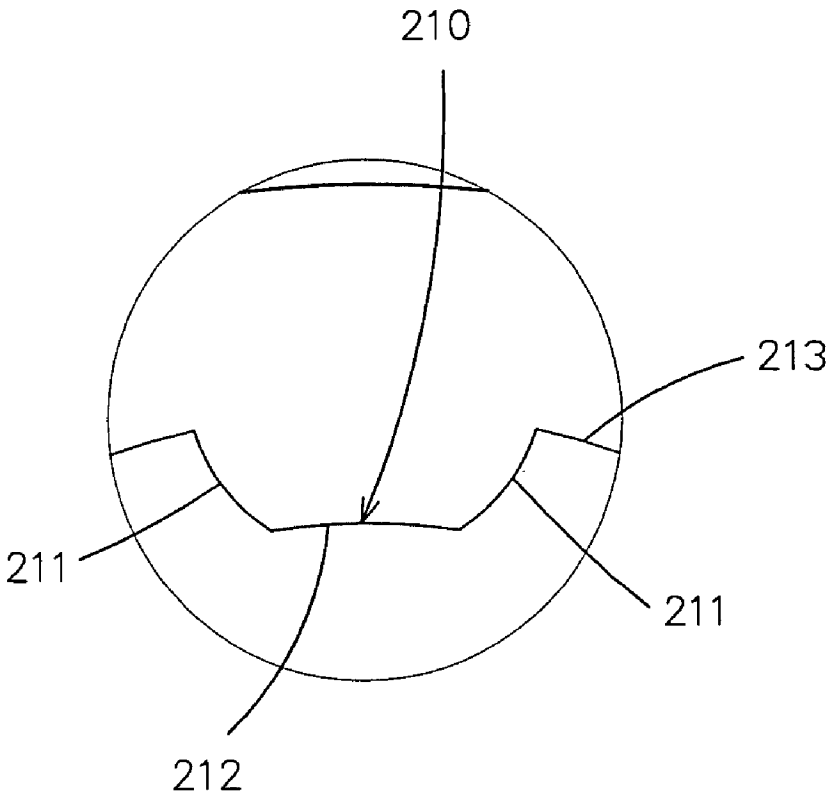
FIG. 3A is a partially enlarged view of the ratchet wrench structure as shown in FIG. 3.

As shown in FIG. 3A, each of the insertion ribs 210 of the ratchet wheel 20 includes two first insertion faces 211 located on the two opposite sides thereof, and a second insertion face 212 located between the two first insertion faces 211. Preferably, each of the two first insertion faces 211 of each of the insertion ribs 210 has an arcuate convex shape. Preferably, the second insertion face 212 of each of the insertion ribs 210 has an arcuate concave shape. In addition, each of the insertion ribs 210 of the ratchet wheel 20 includes a third insertion face 213 located between any two adjacent insertion ribs 210. Preferably, the third insertion face 213 of each of the insertion ribs 210 has an arcuate concave shape.

The socket 40 has one end having an outer periphery formed with a plurality of insertion recesses 41 for insertion of the insertion ribs 210 of the ratchet wheel 20. Each of the insertion recesses 41 of the socket 40 has a shape mating with that of the respective insertion rib 210 of the ratchet wheel 20, so that each of the insertion recesses 41 of the socket 40 is combined with the respective insertion rib 210 of the ratchet wheel 20 rigidly and stably. The other end of the socket 40 is used to mount a screw member (not shown).

The ratchet wrench structure in accordance with the preferred embodiment of the present invention further comprises a locking pawl 30 pivotally mounted in the receiving hole 11 of the wrench body 10 and formed with a plurality of engaging teeth 300 engaging with the ratchet teeth 200 of the ratchet wheel 20.

The ratchet wrench structure in accordance with the preferred embodiment of the present invention further comprises a supporting seat 50 mounted on a bottom of the receiving hole 11 of the wrench body 10 for supporting the ratchet wheel 20 in the receiving hole 11 of the wrench body 10, and a C-shaped snap ring 51 secured on the bottom of the receiving hole 11 of the wrench body 10 for retaining the supporting seat 50 in the receiving hole 11 of the wrench body 10.

Referring to FIGS. 3 and 3A, the socket 40 is inserted into the ratchet wheel 20, so that each of the insertion ribs 210 of the ratchet wheel 20 is inserted into the respective insertion recess 41 of the socket 40. Thus, the socket 40 is combined with the ratchet wheel 20, so that the socket 40 can co-operate with the ratchet wheel 20 to rotate the screw member (not shown) by rotation of the wrench body 10.

Figure 4:
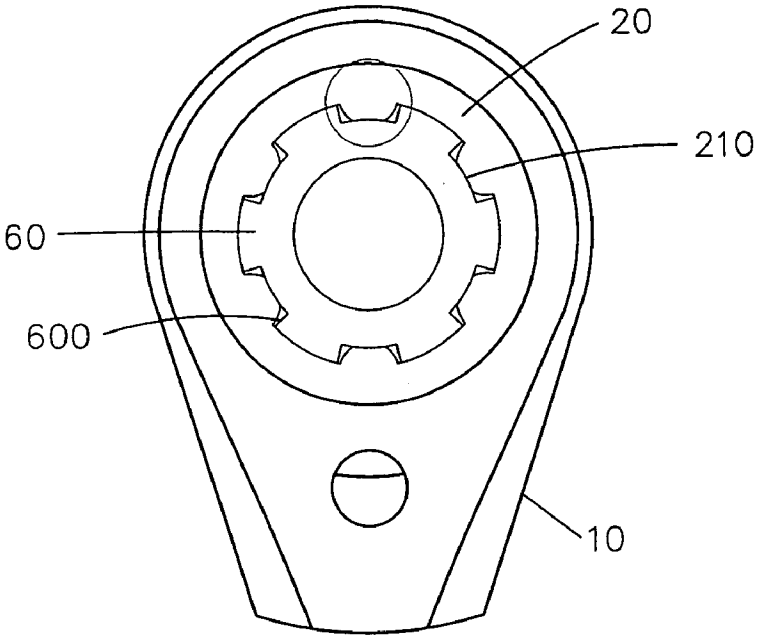
FIG. 4 is a top plan view of the ratchet wrench structure as shown in FIG. 2.
Figure 4A:
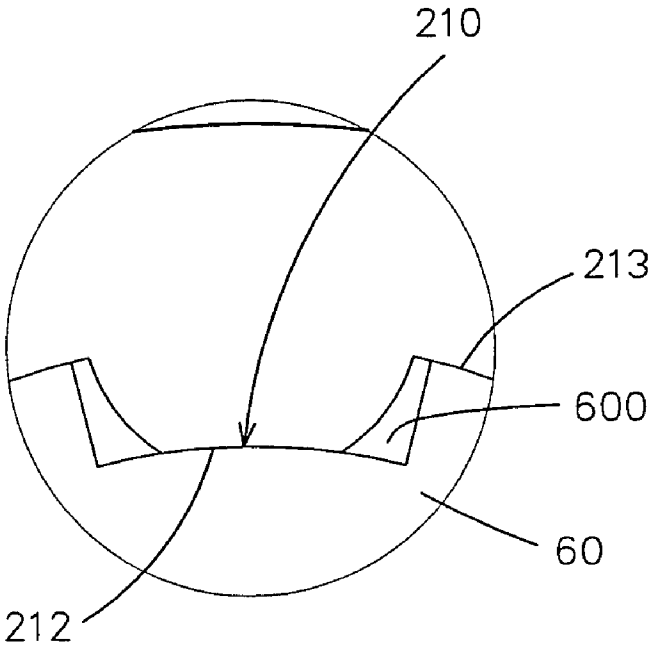
FIG. 4A is a partially enlarged view of the ratchet wrench structure as shown in FIG. 4.

Referring to FIGS. 4 and 4A, each of the insertion recesses 600 of the socket 60 has a sector shape. Thus, when the socket 60 is inserted into the ratchet wheel 20, the second insertion face 212 of each of the insertion ribs 210 is rested on an end face of the respective insertion recess 600 of the socket 60, and the third insertion face 213 of each of the insertion ribs 210 is rested on a side of the respective insertion recess 600 of the socket 60, so that the socket 60 is combined with the ratchet wheel 20 rigidly and stably.

Figure 5:
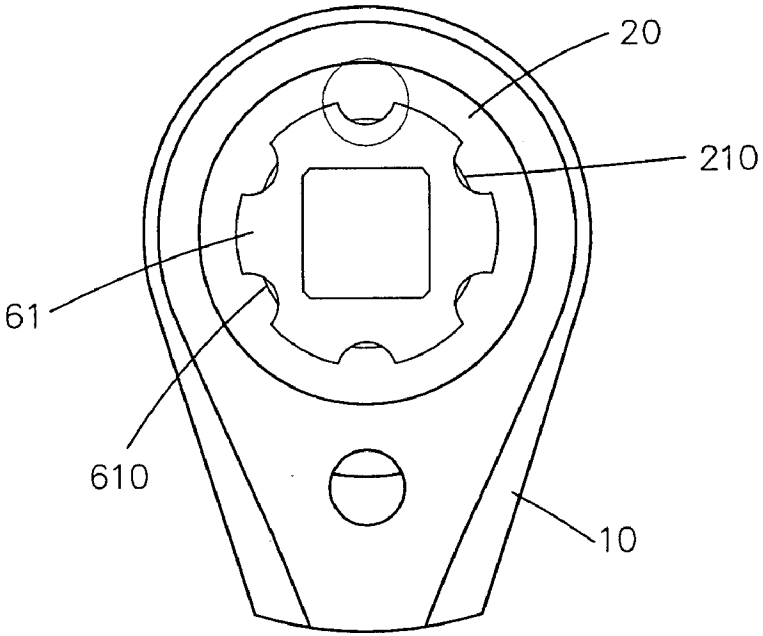
FIG. 5 is a top plan view of the ratchet wrench structure as shown in FIG. 2.
Figure 5A:
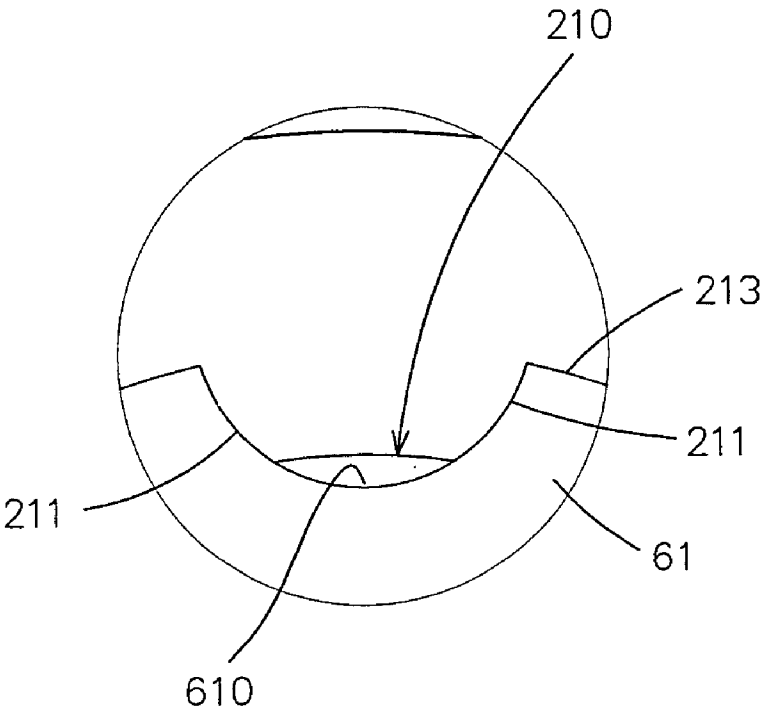
FIG. 5A is a partially enlarged view of the ratchet wrench structure as shown in FIG. 5.

Referring to FIGS. 5 and 5A, each of the insertion recesses 610 of the socket 61 has an arcuate shape. Thus, when the socket 61 is inserted into the ratchet wheel 20, each of the two first insertion faces 211 of each of the insertion ribs 210 is rested on an end face of the respective insertion recess 610 of the socket 61, and the third insertion face 213 of each of the insertion ribs 210 is rested on a side of the respective insertion recess 610 of the socket 61, so that the socket 61 is combined with the ratchet wheel 20 rigidly and stably.

Figure 6:
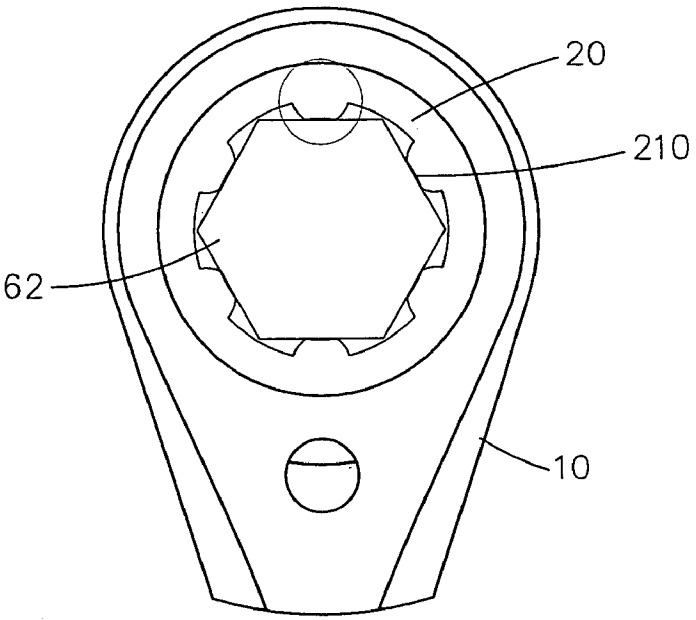
FIG. 6 is a top plan view of the ratchet wrench structure as shown in FIG. 2.
Figure 6A:
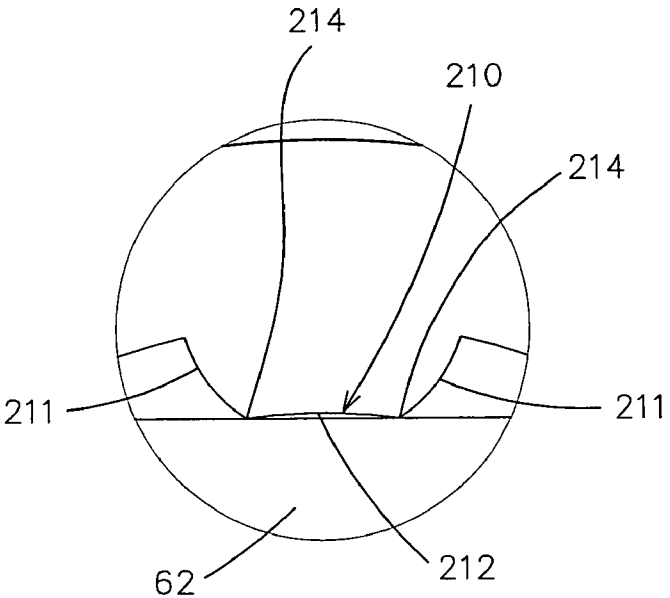
FIG. 6A is a partially enlarged view of the ratchet wrench structure as shown in FIG. 6.

Referring to FIGS. 6 and 6A, each of the insertion ribs 210 of the ratchet wheel 20 includes a connection 214 located between the second insertion face 212 and each of the two first insertion faces 211 of each of the insertion ribs 210. Thus, when the screw member 62 is inserted into the ratchet wheel 20, the connection 214 located between the second insertion face 212 and each of the two first insertion faces 211 of each of the insertion ribs 210 is rested on each side of the screw member 62, so that the screw member 62 is combined with the ratchet wheel 20 rigidly and stably.

Figure 7:
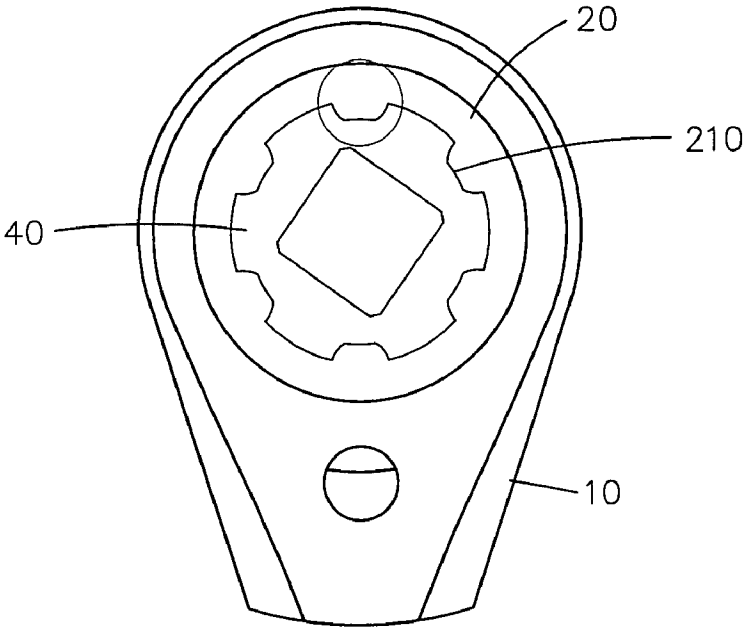
FIG. 7 is a top plan view of the ratchet wrench structure as shown in FIG. 2.
Figure 7A:
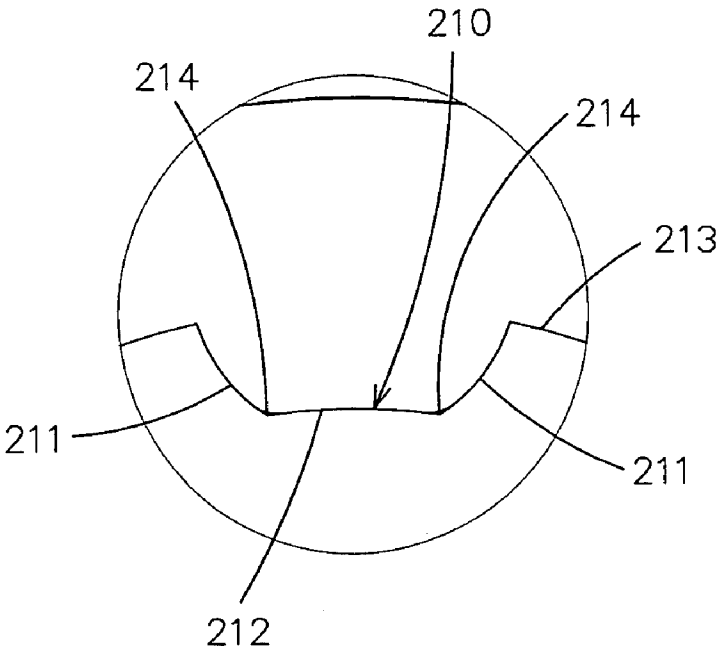
FIG. 7A is a partially enlarged view of the ratchet wrench structure as shown in FIG. 7.
Figure 8:
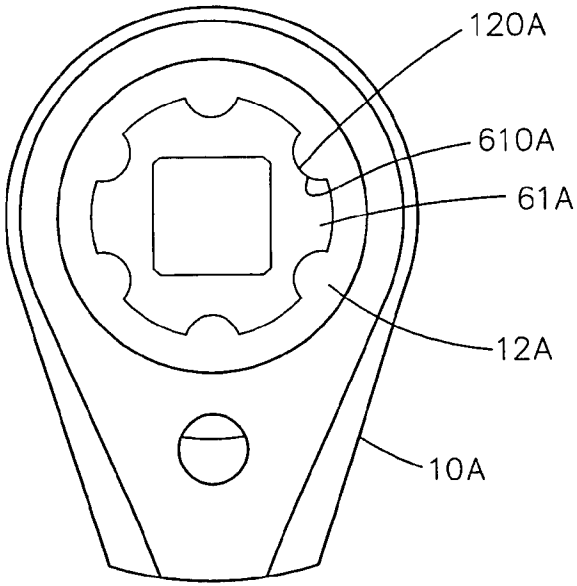
FIG.8 PRIOR ART
FIG. 8 is a top plan assembly view of a first conventional ratchet wrench structure in accordance with the prior art.
Figure 8A:
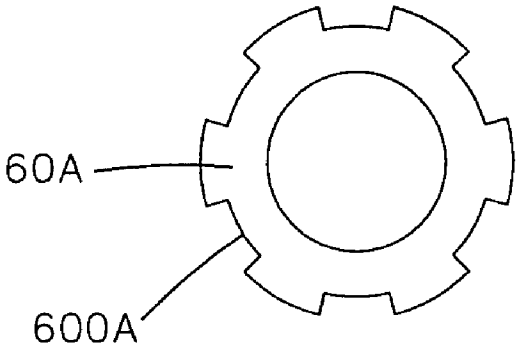
FIG.8A PRIOR ART
FIG. 8A is a top plan view of a socket of the first conventional ratchet wrench structure in accordance with the prior art.
Figure 9:
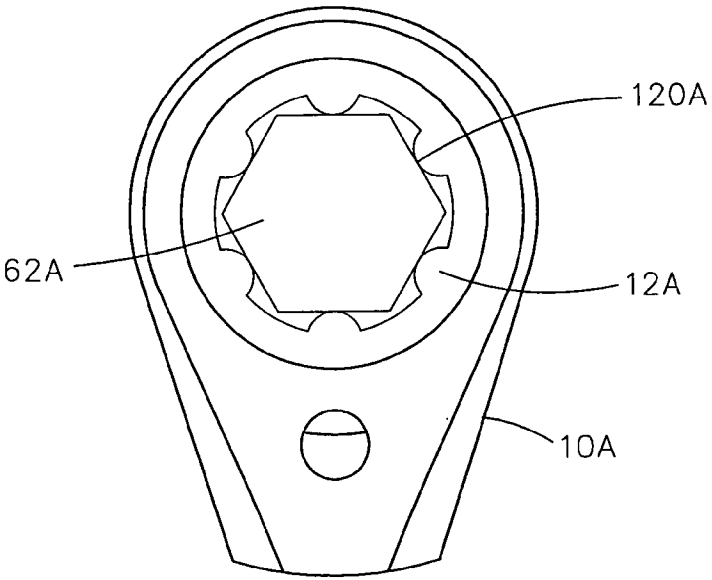
FIG.9 PRIOR ART
FIG. 9 is a top plan assembly view of the first conventional ratchet wrench structure in accordance with the prior art.
Figure 10:
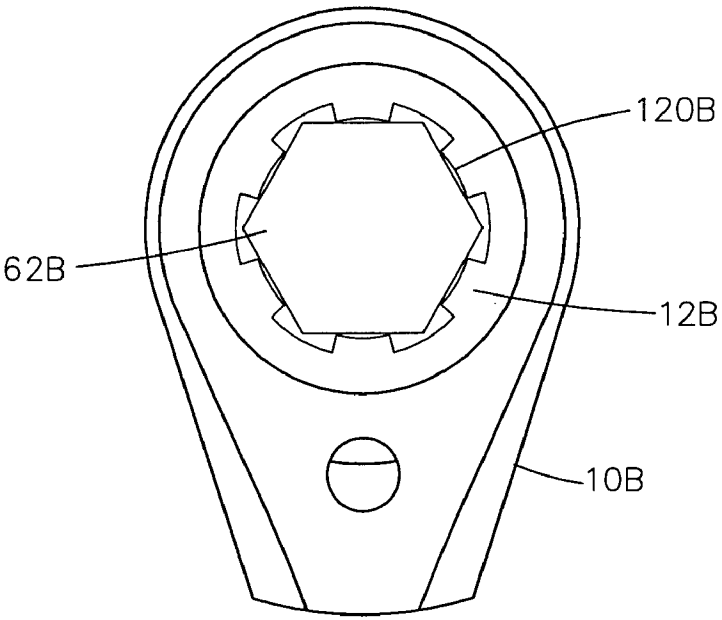
FIG.10 PRIOR ART
FIG. 10 is a top plan assembly view of a second conventional ratchet wrench structure in accordance with the prior art.

Referring to FIGS. 7 and 7A, the connection 214 located between the second insertion face 212 and each of the two first insertion faces 211 of each of the insertion ribs 210 has an arcuate face, thereby increasing the contact area of the ratchet wheel 20 with the socket 40, and thereby enhancing the structural strength of the ratchet wrench structure.

Accordingly, the ratchet wrench structure in accordance with the preferred embodiment of the present invention has the following advantages.

1. The second insertion face 212 of each of the insertion ribs 210 is rested on the end face of the respective insertion recess 600 of the socket 60, so that the ratchet wrench structure is available for the socket 60 with the sector-shaped insertion recesses 600.
2. Each of the two first insertion faces 211 of each of the insertion ribs 210 is rested on the end face of the respective insertion recess 610 of the socket 61, so that the ratchet wrench structure is available for the socket 61 with the arcuate-shaped insertion recesses 610.
3. The two connections 214 located between the second insertion face 212 and each of the two first insertion faces 211 of each of the insertion ribs 210 are rested on each side of the screw member 62, so that the screw member 62 is combined with the ratchet wheel 20 rigidly and stably without incurring a slip movement.
4. The two connections 214 located between the second insertion face 212 and each of the two first insertion faces 211 of each of the insertion ribs 210 are rested on each side of the screw member 62, thereby producing more contact points between the screw member 62 and the ratchet wheel 20, so that the structural strength of the ratchet wrench structure is enhanced.
5. Each of the insertion ribs 210 and the screw member 62 have a larger contact area, thereby preventing the insertion ribs 210 from being worn out due to rubbing actions.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench structure, comprising a wrench body, a ratchet wheel, and a socket, wherein:

the wrench body has a head formed with a receiving hole;

the ratchet wheel is rotatably mounted in the receiving hole of the wrench body and has a center formed with a combination hole, the combination hole of the ratchet wheel has an inner periphery formed with a plurality of insertion ribs, each of the insertion ribs of the ratchet wheel includes discontinuous faces including two arcuate convex shaped first insertion faces located on two opposite sides thereof and each extended radially outward therefrom, an arcuate concave shaped second insertion face located between the two first insertion faces and extended radially inward therefrom, and an arcuate concave shaped third insertion face extended from a respective first insertion face;

the socket has one end having an outer periphery formed with a plurality of insertion recesses for insertion of the insertion ribs of the ratchet wheel;

each of the insertion recesses of the socket has a shape mating with that of a respective insertion rib of the ratchet wheel.

2. The ratchet wrench structure in accordance with claim 1, further comprising a supporting seat mounted on a bottom of the receiving hole of the wrench body for supporting the ratchet wheel in the receiving hole of the wrench body, and a C-shaped snap ring secured on the bottom of the receiving hole of the wrench body for retaining the supporting seat in the receiving hole of the wrench body.

3. The ratchet wrench structure in accordance with claim 1, wherein each of the insertion ribs of the ratchet wheel includes a connection located at an apex intersection between the second insertion face and each of the two first insertion faces of each of the insertion ribs.

4. The ratchet wrench structure in accordance with claim 3, wherein the connection located between the second insertion face and each of the two first insertion faces of each of the insertion ribs has an arcuate face extended radially outward therefrom.

5. The ratchet wrench structure in accordance with claim 1, wherein each of the insertion recesses of the socket has a sector shape having an arcuate convex shaped end face, and the arcuate concave shaped second insertion face of each of the insertion ribs is closely rested on the arcuate convex shaped end face of a respective insertion recess of the socket.

6. The ratchet wrench structure in accordance with claim 1, wherein each of the insertion recesses of the socket has an arcuate shape, and each of the two first insertion faces of each of the insertion ribs is rested on an end face of a respective insertion recess of the socket.

* * * * *